US011672320B2

(12) United States Patent
Depace

(10) Patent No.: US 11,672,320 B2
(45) Date of Patent: Jun. 13, 2023

(54) MAKEUP REMOVING DEVICE

(71) Applicant: Cindy Depace, Carlsbad, CA (US)

(72) Inventor: Cindy Depace, Carlsbad, CA (US)

( * ) Notice: Subject to any disclaimer, the term of this patent is extended or adjusted under 35 U.S.C. 154(b) by 356 days.

(21) Appl. No.: 16/942,876

(22) Filed: Jul. 30, 2020

(65) Prior Publication Data

US 2021/0030136 A1 Feb. 4, 2021

Related U.S. Application Data

(60) Provisional application No. 62/880,260, filed on Jul. 30, 2019.

(51) Int. Cl.

| | |
|---|---|
| ***A45D 34/04*** | (2006.01) |
| ***A45D 34/00*** | (2006.01) |
| ***A45D 40/24*** | (2006.01) |
| ***A45D 40/26*** | (2006.01) |
| ***A61Q 1/14*** | (2006.01) |

(52) U.S. Cl.

CPC ..... *A45D 34/045* (2013.01); *A61Q 1/14* (2013.01); *A45D 40/24* (2013.01); *A45D 40/265* (2013.01); *A45D 2034/002* (2013.01)

(58) Field of Classification Search

CPC ..... A45D 34/045; A45D 2034/002; A45D 40/24; A45D 40/265; A45D 34/042; A45D 40/262; A45D 34/00; A45D 40/26; A61Q 1/14

USPC ..... 401/16–18, 23, 24, 126–130

See application file for complete search history.

(56) References Cited

U.S. PATENT DOCUMENTS

| | | | | |
|---|---|---|---|---|
| 5,320,442 | A * | 6/1994 | Yanagisawa | B43K 24/06 401/23 |
| 6,328,040 | B1 * | 12/2001 | Stein | A45D 40/04 132/74.5 |
| 6,896,433 | B1 * | 5/2005 | Zhang | A45D 34/042 401/25 |
| 9,004,791 | B2 * | 4/2015 | Acierto | A45D 40/24 401/44 |
| 2003/0185616 | A1 * | 10/2003 | Dumler | A46B 9/021 401/16 |
| 2010/0050352 | A1 * | 3/2010 | Deris | A46B 15/0061 132/316 |

* cited by examiner

*Primary Examiner* — David J Walczak

(57) ABSTRACT

A compact makeup removing device includes a reservoir filled with a gel or liquid makeup remover, a tip assembly coupled to a first end of the reservoir for dispensing the makeup remover and a twistable middle section, coupled to a second end of the reservoir, for causing the makeup remover to be dispensed through the tip assembly when the twistable middle section is rotated by a user.

18 Claims, 6 Drawing Sheets

FIG. 6A
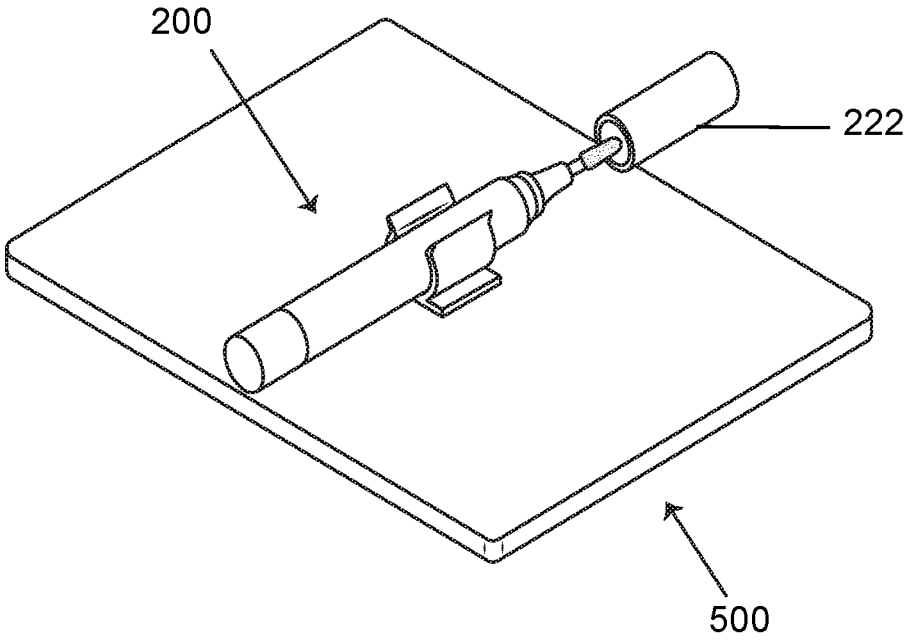
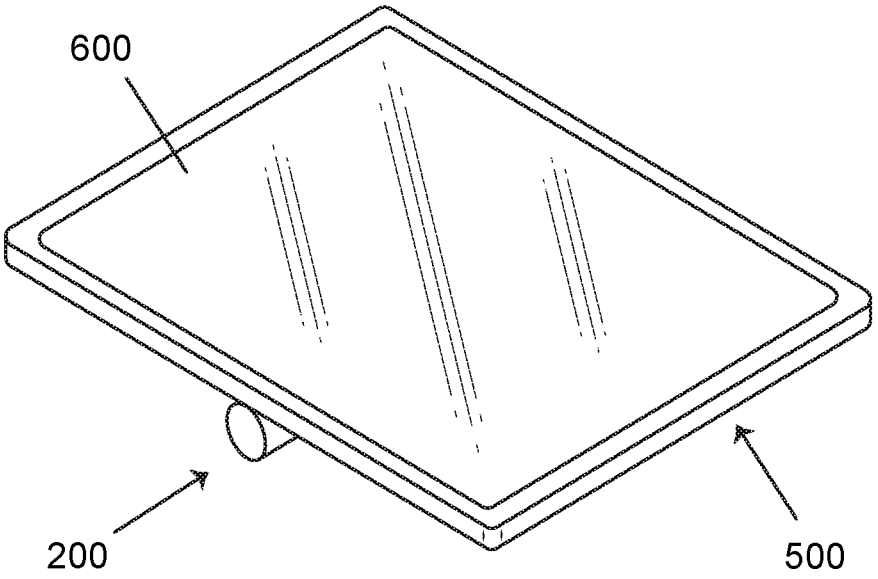
FIG. 6B

MAKEUP REMOVING DEVICE

I. CROSS-REFERENCE TO RELATED APPLICATIONS

This application claims the benefit of U.S. provisional patent application No. 62/880,260, filed on Jul. 30, 2019, incorporated by reference herein in its entirety.

BACKGROUND

I. Field of Use

The present application relates to the beauty industry. More specifically, the present application relates to a device for removing and/or applying makeup.

II. Description of the Related Art

There are many makeup applicators on the market today that dispense makeup by twisting a base of a tubular device. The most know example of this is most likely lipstick, but other forms of makeup are also available in such a twistable dispensing device, such as foundation, eye shadow and eye liner. However, there is no such mechanism available on the market today that dispenses makeup remover and, moreover, no products on the market that dispense makeup remover in a sanitary manner. To remove makeup, one must generally use a washcloth with soap and water, makeup remover, or disposable towelettes or wipes. Such methods are generally used to remove all of a woman's makeup but may be bulky and generally not convenient to carry in a clutch or bag. Additionally, there are times when it is desirable to remove only a portion of makeup, such as to re-color an eye shadow at work just prior to going out to dinner, or to fix a small portion of makeup if it was applied incorrectly. The prior art makeup removing techniques for removing makeup are not suitable to remove makeup in precise areas of the face. Nor are they normally carried by woman at work or in social situations.

SUMMARY

The embodiments described herein relate to a compact makeup removal device. In one embodiment, the compact makeup removal device comprises a reservoir filled with a gel or liquid makeup remover, a tip assembly coupled to a first end of the reservoir for dispensing the makeup remover and a twistable middle section, coupled to a second end of the reservoir, for causing the makeup remover to be dispensed through the tip assembly when the twistable middle section is rotated by a user.

In another embodiment, a compact makeup removal device comprises a first reservoir for holding a liquid or gel makeup remover, a second reservoir for holding liquid, gel or compact wax makeup; and a double-ended wand.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein:

FIG. 6A is a rear, perspective view of the compact mirror as shown in FIG. 5 while retaining any of the devices shown in FIGS. 1-4; and FIG. 6B is a front, perspective view of the compact mirror as shown in FIG. 5, also while retaining any of the devices shown in FIGS. 1-4.

DETAILED DESCRIPTION

Several embodiments of a makeup removing device are disclosed. While described in some embodiments as a makeup remover only, in other embodiments a makeup remover and applicator are incorporated into a single apparatus. Further, it should be understood that the elements of a makeup remover described herein may also be applicable to makeup applicators. In some embodiments, a makeup removing device comprises removable, disposable tips for applying makeup remover liquid or gel. Disposability provides a sanitary mechanism to prolong the useful life of such makeup removing devices.

Figure 1:
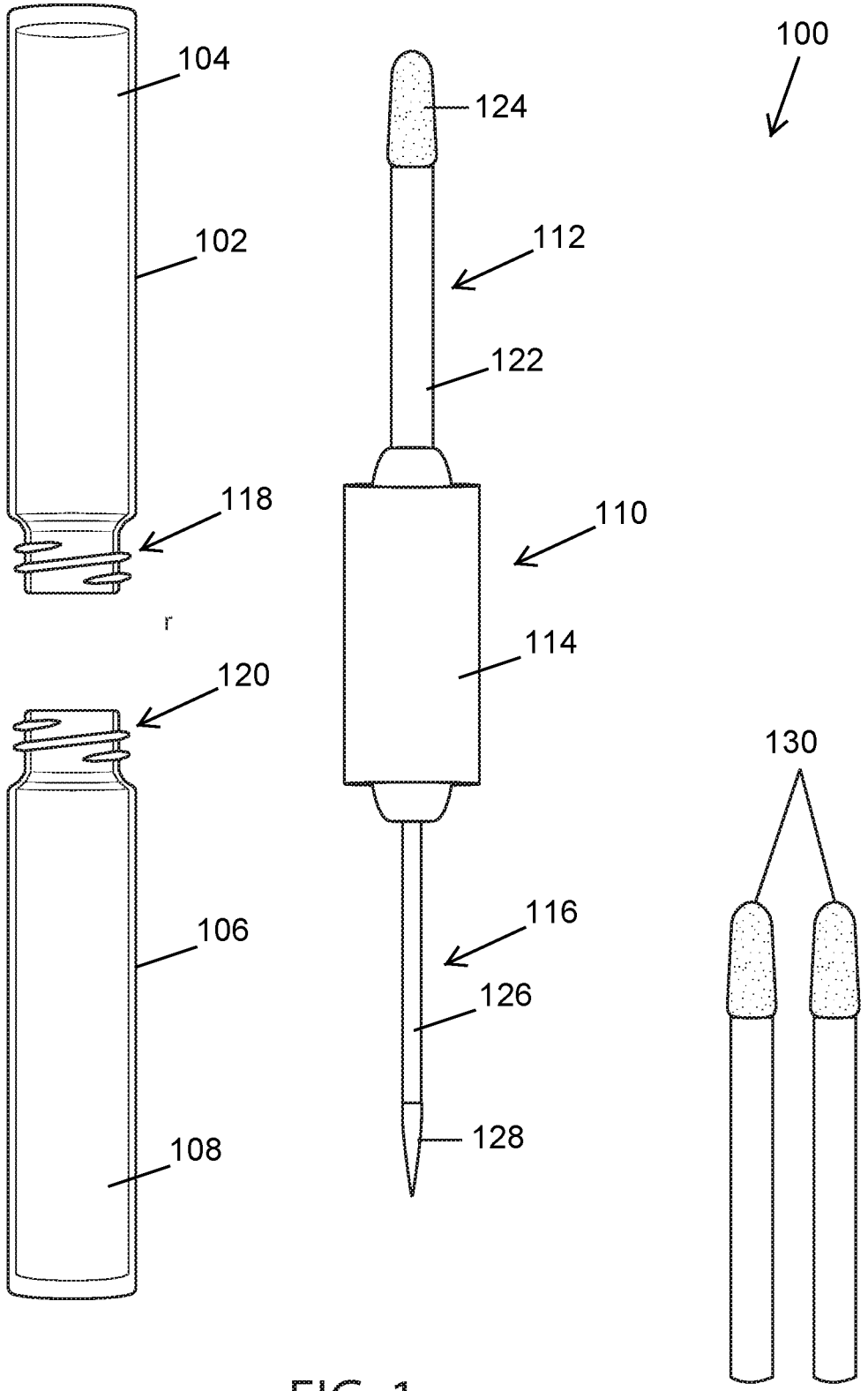
FIG. 1 is a side, plan view of one embodiment of a combination makeup removing apparatus and makeup applicator along with two replacement tips.

In a first embodiment, shown in FIG. 1, a combination makeup removing apparatus and makeup applicator 100 is shown in three pieces, comprising a first reservoir 102 for holding a liquid or gel makeup remover 104 (such as solublizers, surfactants and/or emulsifiers), a second reservoir 106 for holding liquid, gel or powder makeup 108 (such as eyeliner, mascara, foundation, rouge, etc.) and a double-ended wand 110. The overall length of makeup removing apparatus and makeup applicator 100 is approximately between 6 and 10 inches long, having a maximum diameter of between ½ inch and 2 inches. It should be understood that the various components shown in FIG. 1 may not be to scale with each other.

The makeup remover 104 comprises a liquid or gel having a viscosity ranging from 1-200 poise (in examples of relatively low viscosity makeup removers) and/or a liquid or gel having a viscosity ranging from 1,000 to 15,000 poise (in examples of relatively high viscosity makeup removers). In low viscosity embodiments, the makeup remover 104 generally comprises an anhydrous skin cleansing composition containing an oil phase, an emulsifying agent, and particulate water soluble polymeric abrasive particles, i.e., 50-90% of an oily phase, 1-30% of an emulsifying agent; and 1-10% of a polymeric particulate abrasive. In high-viscosity embodiments, the makeup remover 104 comprises polyethylene, polyethylene copolymer and a gelable oil base, which base can be comprised of a mixture of mineral oils and branched natural or branched synthetic esters, or a mixture of just branched natural or branched synthetic esters. In some embodiments the composition further includes branched non-ionic alkoxylated alcohol surfactants with at least a 20 carbon branched chain, a preservative mixture and a mixture of natural oils.

The double-ended wand 110 comprises a makeup remover wand 112 extending from a base 114, and a makeup applicator wand 116 extending in an opposite direction from the base 114. The base 114 is sized so that the double ended wand 110 is easily held between a user's thumb and forefinger, and comprises two sets of internal threads (not shown), a first set for engaging external threads 118 formed at on open end of the first reservoir 102, and a second set of threads for engaging external threads 120 formed at an open end of the second reservoir 106.

The makeup remover wand 112 comprises a first support member 122 coupled, at one end, inside the base 114 and extending therefrom approximately 2-3 inches, having a tip 124 at an opposing end that is capable of absorbing the makeup remover 104 when tip 124 is inserted into the first reservoir 102. The tip 124 may comprise a sponge, foam rubber, neoprene, or some other natural or man-made absorbent material, or it may comprise a small brush or other mechanism capable or retaining the makeup remover 104. In some embodiments, makeup remover wand 112 is removably coupled to the base 114, i.e., it is may be replaced with other makeup removers without using tools.

The makeup applicator wand 116 comprises a second slender support member 126, also coupled, at one end, perpendicularly to the base 114 and also extending therefrom, in an opposing direction as the first slender support member 122, approximately 2-3 inches. In other embodiments, the length and/or diameter of each of the support members may be different and, in some embodiments, different from each other. A tip 128 of the second slender support member 126 is configured to retain some of the makeup 108 that is stored in the second reservoir 106 upon removal of the second applicator from the second reservoir 106. For example, the second tip 128 may comprise a small brush, sponge, or other makeup applicator.

The tip on one, or both, applicators may be configured to be replaceable. In one embodiment, only the tip is replaceable, typically be a retaining mechanism formed into the ends of one or both applicators and a reciprocal retaining mechanism formed on a base of a tip. In another embodiment, the entirety one or both applicators are configured to be removable, and replaceable, from the base 114, using a mechanical fastening technique at the end of one or both applicators where they connect to the base 114. In one embodiment, the tip, or the applicators, may be formed from materials that allow them to be washed and re-used, so that replacement applicators are not necessary. The mechanical fastening technique could comprise threads formed on the surface of one end of an applicator and reciprocal, internal threads formed inside the base 114. A pair of replacement applicators are shown as applicators 130 in FIG. 1.

In some embodiments, liquid or gel is not stored in one or both of the reservoirs. Instead, one or both support members may be hollow, and pre-filled with either liquid or gel makeup or makeup remover, where the makeup or makeup remover is dispensed either by gravity (by holding the wand 110 in a position where one of the tips is in a downward position) or by squeezing base 114, in an embodiment where base 114 is made of a deformable material, such as plastic. In this embodiment, each replacement applicator 130 may comprise the makeup or makeup remover.

Figure 2:
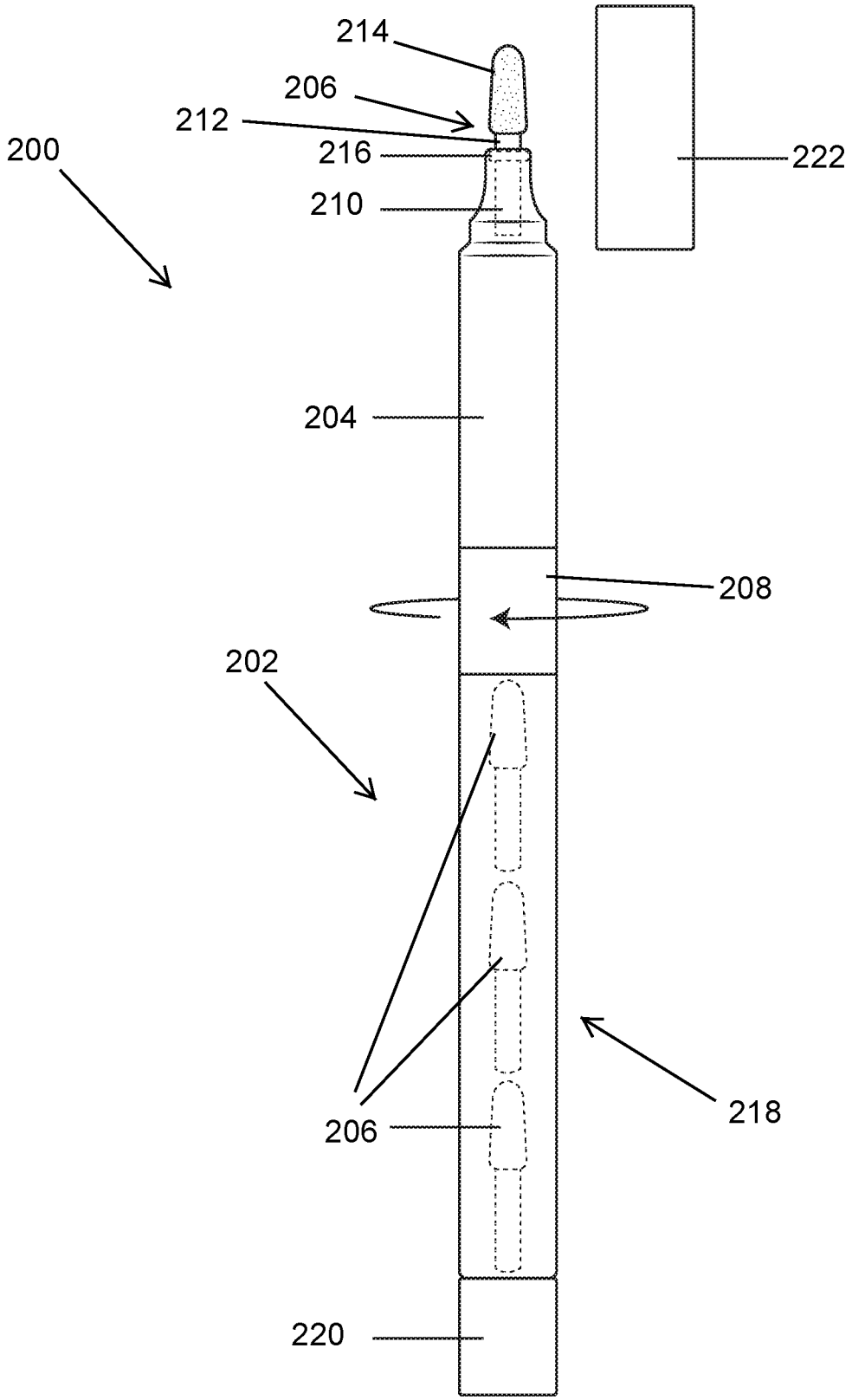
FIG. 2 is a side, plan view of one embodiment of a makeup removing device.

FIG. 2 illustrates one embodiment of a makeup removing device 200. In this embodiment, the device 200 comprises a slender tube 202 having a first reservoir 204 filled with makeup remover that is dispensed through a fixed or replaceable tip assembly 206 as a twistable middle section 208 is twisted. Twisting the middle section 208 causes a mechanical actuator inside the first section to force liquid or gel makeup or makeup remover up through, in this embodiment, a hollow tube 210 of each tip assembly 206, through a hollow extension 212 and into a tip 214, comprising a spongy or absorbent material, where the makeup or makeup remover is received from the hollow extension and onto a surface of the tip 214 as the makeup or makeup remover is forced into the tip 214 by the mechanical actuator, thus allowing the makeup or makeup remover to be applied to a user's body. The selection of material for tip 214 is generally determined by the viscosity of the makeup remover inside first reservoir 204. In one embodiment, the tip 214 comprises a porous structure, similar or identical to a sponge, where the more viscous the makeup remover, the larger the holes, or pores, of tip 214 must be in order for the makeup remover to be dispersed without undue hardship to a user. For example, at a viscosity near 1, the pores of tip 214 can be very small, i.e., less than 1 mm in diameter, but for a viscosity of 8,000, the pores would need to be 5 mm or more in diameter.

In one embodiment, a deformable grommet 216 is located inside the first reservoir 204 at the end where the replacements tips are inserted. The deformable grommet 216 is made from a pliable or spongy-type material, such as plastic, rubber, sponge, neoprene, etc., that has a hole formed through it longitudinally to allow the hollow tube 210 of the tip assembly 206 to pass through the grommet 216 into the reservoir of makeup or makeup remover held inside first reservoir 204. The selected material of the grommet 216, and its dimensions, is such that it can mechanically support the tip assembly 206 as a user applies or removes makeup, as the case may be. For example, in an example where hollow extension 212 is two inches long, tip assembly 206 may need to withstand up to 2 inch-pounds of torque, where the force of a user applying makeup or makeup remover using makeup removing device 200 is up to 1 pound of force. Additional mechanical support for the tip assembly 206 may be achieved by adding a fastening mechanism, such as screw threads, or some other known fastening mechanism. In other embodiments, hollow tube 210 and is not used and hollow extension 212 is secured mechanically to first reservoir 204 via known fastening techniques.

A second section 218 of the makeup removing device 200 comprises a tubular compartment and is configured to hold a number of replacement tip assemblies 206. A removable cap 220 holds the replacement tip assemblies inside the second section 218, while a second removable 222 cap covers the current replacement tip assembly 206 when the device is not in use.

The overall length of makeup removing device 200 is approximately between 4 and 8 inches long, having a maximum diameter of between ½ inch and 2 inches. It should be understood that the various components shown in FIG. 2 may not be to scale with each other.

Figure 3:
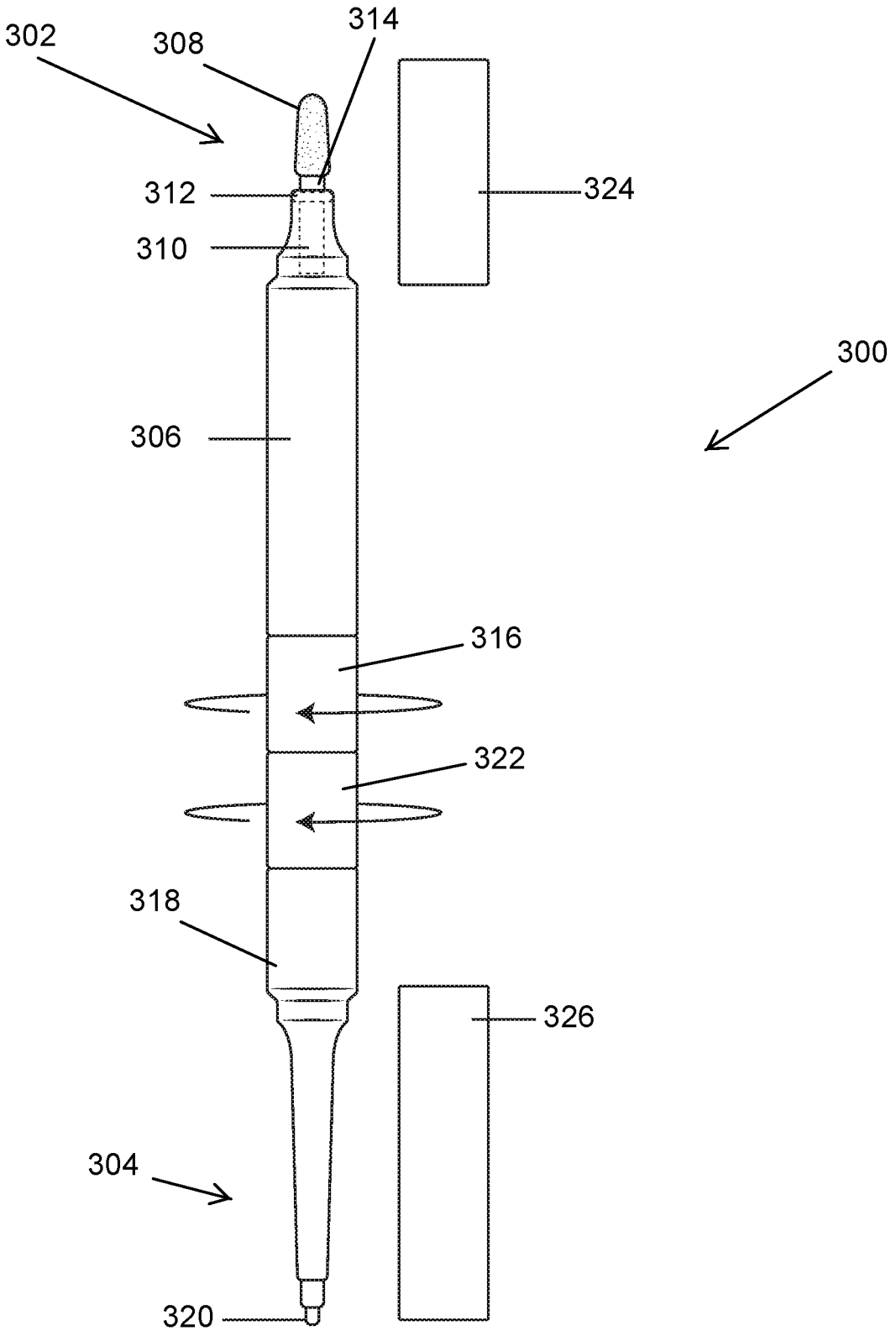
FIG. 3 is a side, plan view of another embodiment of a combination makeup removing apparatus and makeup applicator.

FIG. 3 illustrates yet another embodiment of a makeup removing device in the form of a double-ended wand 300. In this embodiment, a first end 302 comprises a makeup remover and a second end 304 comprises a makeup applicator. The first end 302, the makeup remover, is the same as the first reservoir 204 of the makeup removing device 200 as shown in FIG. 2, comprising a first section 306 filled with makeup remover that is dispensed through a fixed or replaceable tip 308 via, in one embodiment, a hollow tube 310, grommet 312, and hollow extension 314 as a first middle section 316 is twisted. In other embodiments, hollow tube 310 is not used and hollow extension 314 is secured mechanically to first section 306 via known fastening techniques. The second end 304 is similar to the first end 302, comprising a second section 318 filled with makeup that is dispensed through a fixed or replaceable tip 320 as a second middle section 322, abutting the first middle section 316, is twisted. Each end may be fitted with a respective cap 324 and 326 to protect the tips and prevent them from drying out.

The overall length of the double-ended wand 300 is approximately between 4 and 8 inches long, having a maximum diameter of between ½ inch and 2 inches. It should be understood that the various components shown in FIG. 3 may not be to scale with each other.

Figure 4:
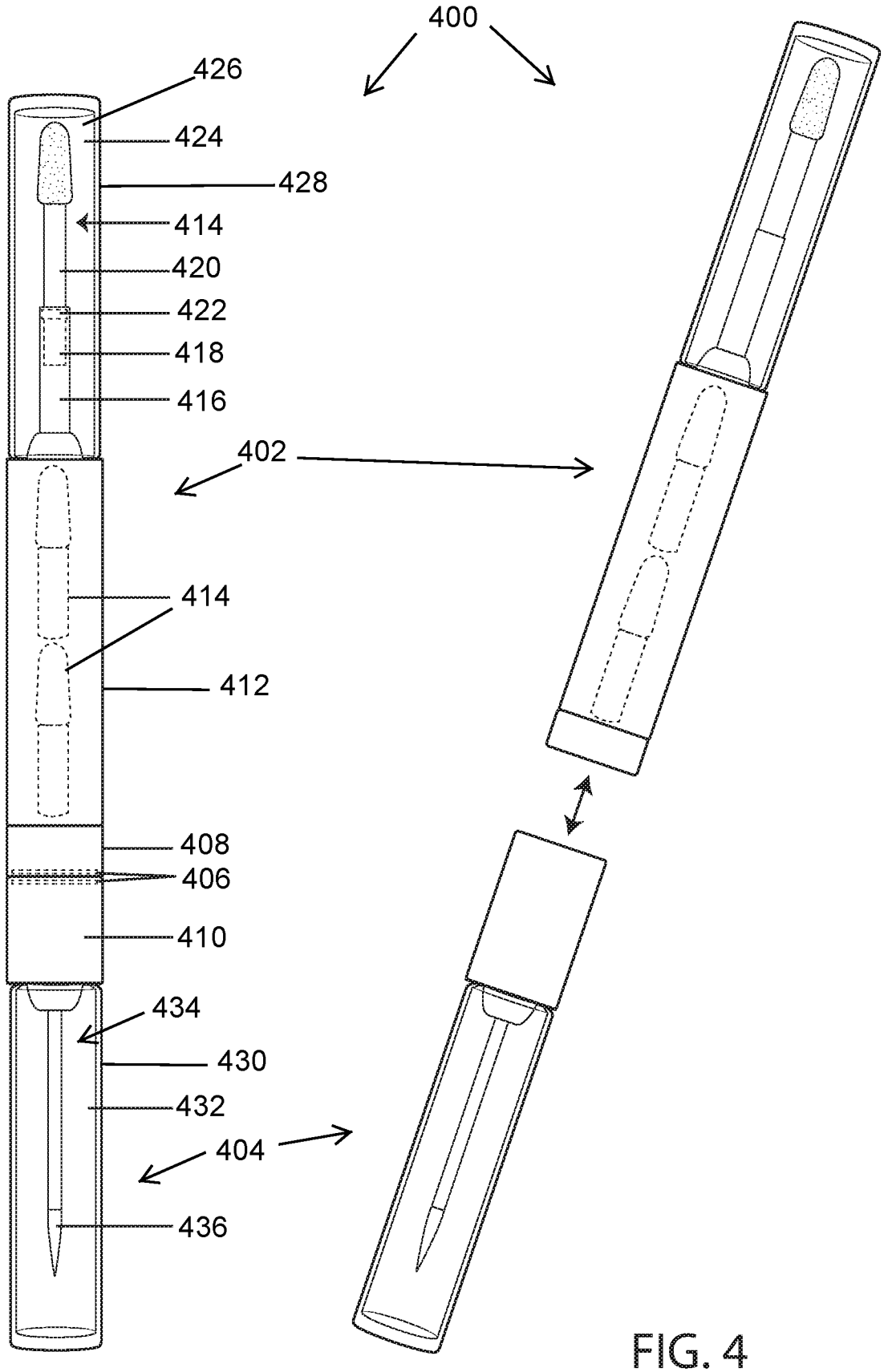
FIG. 4 is a side, plan view of another embodiment of a makeup removing device.

FIG. 4 is a side, plan view of another embodiment of a makeup removing device, shown as device 400, shown on the left as a unit and, on the right, decoupled into two separate devices, a makeup removing portion 402 and a makeup applicator portion 404. The makeup removing portion 402 and makeup applicator portion 404 are held together, when assembled as a unit, by at least one magnet 406 located inside or on a removable cap 408 and/or removable base 410, located at one end of the makeup removing portion 402 and/or makeup removing portion 402, respectively. In some embodiments, a magnetically-attractable ferrous metal is imposed in or on the cap 408 and/or base 410 in combination with a magnet in the opposite cap or base, as the case may be. In another embodiment, the cap 408 of the makeup removing portion 402 and the base 410 of the makeup applicator portion 404 each comprises a magnet, and the magnets are polarized such that the cap 408 of the makeup removing portion 402 and the base 410 of makeup applicator portion 404 attract one another. In this way, the two portions are easily separable from each other but form an attractive, sleek, multipurpose makeup applicator/remover when joined together by the magnet(s).

In this embodiment, the makeup removing portion 402 comprises a cylindrical, hollow body portion 412 with the aforementioned removable cap 408 on one end and a first replaceable tip assembly 414 extending longitudinally from a non-detachable replacement sponge receiver 416 located at the other end of body portion 412. In this example, non-detachable replacement sponge receiver 416 comprises a cylindrically-shaped stub having a first end fixed to the hollow body portion 412, and the other end comprising a deformation 418 formed into the other end, sized and shaped to receive a shaft 420 of the replaceable tip assembly 414. In some embodiments, a deformable grommet 422 or other mechanical fastening mechanism is used as shown in order to secure the replaceable tip assembly 414 within the deformation 418, while still allowing replaceable tip assembly 414 to be easily removed without tools from the deformation 418 at any time by a user. The replaceable tip assembly 414 comprises the shaft 420 and a tip 424, such as a sponge, or some other absorbent material, for absorbing or carrying some makeup remover 426 from a makeup remover reservoir 428. It should be understood that in FIG. 4, the components 414-426 are all located inside reservoir 428. These components are not shown in hidden, dashed lines for clarity. The makeup remover reservoir 428 is removably secured to the body portion 412 via reciprocal threads formed on an inside end of the makeup remover reservoir 428 and externally around a first end of body portion 412, as well known in the art. As in previous embodiments, the tip 424 may alternatively comprise foam rubber, neoprene, or some other natural or man-made absorbent material, or it may comprise a small brush or other mechanism capable or retaining some of the makeup remover 426.

The makeup removing portion 402, in this embodiment, is additionally configured to store a number of replacement tip assemblies 414 therein, as shown, similar to the embodiment as shown in FIG. 2. The overall length of the device 400 is approximately between 4 and 8 inches long, having a maximum diameter of between ½ inch and 2 inches. It should be understood that the various components shown in FIG. 4 may not be to scale with each other.

The makeup applicator portion 404 comprises a makeup reservoir 430 removably coupled to the applicator base 410 via mechanical fastening means such as threads, a clasp, a latch or other well-known fastening mechanism. The makeup reservoir 430 holds liquid, gel, powder or compact wax makeup 432, such as eyeliner, eye shadow, rouge, lipstick, foundation, etc. When the reservoir 430 is coupled to the base 410, a makeup applicator wand 434 extends from the base 410 into the reservoir 430. The makeup applicator wand 434 comprises a tip 436 that transfers some of the makeup in the reservoir 430 onto the tip 436. As before, the tip 436 comprises a sponge, foam rubber, neoprene, or some other natural or man-made absorbent material, or it may comprise a small brush or other mechanism capable or retaining some of the makeup 432. The tip 436 is exposed by removing the makeup reservoir 430 from the base 410.

Figure 5:
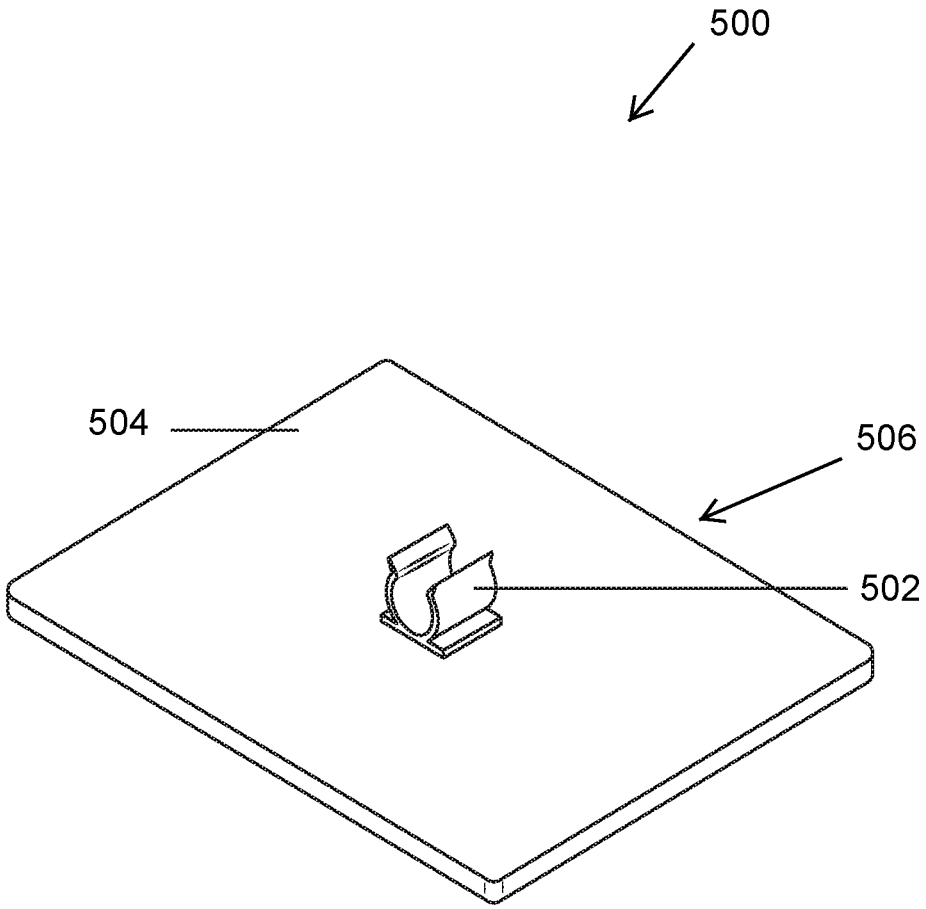
FIG. 5 is a rear, perspective view of a compact mirror having a clip on a back side of the mirror, the clip for removably retaining one or more embodiments of the makeup applicator/removal devices as shown in FIGS. 1-4.

FIG. 5 illustrates a compact mirror 500 having a clip 502 on a back, non-mirrored side 504 (as shown) of the mirror 500, the clip 502 for removably retaining one or more embodiments of the makeup applicator/removal device as shown in FIGS. 1-4. The clip 502 is fixedly mounted to the back side 504 of the compact mirror 500, for example, a mirror 3 inches by 2 inches (the various components shown in FIG. 5 may not be to scale with each other). As shown in FIG. 6A, the clip is sized to removably retain one of the makeup applicator/removal devices around a circumference of a portion of such a device, while allowing the device to be easily removed from the clip by a gentle, pulling force by a user, without the use of tools.

FIG. 6A is a rear perspective view of the compact mirror 500 of FIG. 5 shown with makeup removing device 200 held by clip 502, and 6B is a front perspective view of the compact mirror 500 shown in FIG. 5, also while retaining makeup removing device 200 partially hidden from view. Shown is mirrored surface 600.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

I claim:

1. An apparatus for removing makeup, comprising:

a reservoir filled with a gel or liquid makeup remover;

a tip assembly coupled to a first end of the reservoir for dispensing the makeup remover;

a twistable middle section, coupled to a second end of the reservoir, for causing the makeup remover to be dispensed through the tip assembly when the twistable middle section is rotated by a user;

a tubular compartment coupled to the twistable middle section sized to hold one or more replacement tip assemblies;

a removable cap for holding the replacement tip assemblies inside the tubular compartment, the removable cap comprising a ferrous material disposed in or on thereon; and a makeup applicator portion coupled to the removable cap, comprising a magnet disposed in or on thereon, wherein the makeup applicator portion is removably coupled to the removable cap via a magnetic attraction between the magnet and the ferrous material.

2. The apparatus of claim 1, wherein the makeup remover comprises a viscosity of between 1 and 200 poise.

3. The apparatus of claim 2, wherein the makeup remover comprises an anhydrous skin cleansing composition containing an oil phase, an emulsifying agent, and particulate water soluble polymeric abrasive particles.

4. The apparatus of claim 1, wherein the tip assembly comprises:

a hollow extension inserted into the first end of the reservoir; and a porous tip, coupled to the hollow extension, for passing the makeup remover from the hollow extension and onto a surface of the tip.

5. The apparatus of claim 1, wherein the tip assembly is removably coupled to the first end of the reservoir.

6. The apparatus of claim 1, further comprising:

a compact mirror, comprising a mirrored surface and an opposing non-mirrored surface; and a clip coupled to the non-mirrored surface, the clip sized to removably retain the apparatus around a circumference of the reservoir.

7. An apparatus for removing makeup, comprising:

a reservoir filled with a gel or liquid makeup remover;

a tip assembly coupled to a first end of the reservoir for dispensing the makeup remover; and a twistable middle section, coupled to a second end of the reservoir, for causing the makeup remover to be dispensed through the tip assembly when the twistable middle section is rotated by a user;

a makeup applicator portion coupled to the removable cap a tubular compartment coupled to the twistable middle section sized to hold one or more replacement tip assemblies;

a removable cap for holding the replacement tip assemblies inside the tubular compartment, the removable cap comprising a magnet disposed in or on thereon; and a makeup applicator portion coupled to the removable cap, comprising a ferrous material disposed in or on thereon, wherein the makeup applicator portion is removably coupled to the removable cap via a magnetic attraction between the magnet and the ferrous material.

8. The apparatus of claim 7, wherein the makeup remover comprises a viscosity of between 1 and 200 poise.

9. The apparatus of claim 8, wherein the makeup remover comprises an anhydrous skin cleansing composition containing an oil phase, an emulsifying agent, and particulate water soluble polymeric abrasive particles.

10. The apparatus of claim 7, wherein the tip assembly comprises:

a hollow extension inserted into the first end of the reservoir; and a porous tip, coupled to the hollow extension, for passing the makeup remover from the hollow extension and onto a surface of the tip.

11. The apparatus of claim 7, wherein the tip assembly is removably coupled to the first end of the reservoir.

12. The apparatus of claim 7, further comprising:

a compact mirror, comprising a mirrored surface and an opposing non-mirrored surface; and a clip coupled to the non-mirrored surface, the clip sized to removably retain the apparatus around a circumference of the reservoir.

13. An apparatus for removing makeup, comprising:

a reservoir filled with a gel or liquid makeup remover;

a tip assembly coupled to a first end of the reservoir for dispensing the makeup remover; and a twistable middle section, coupled to a second end of the reservoir, for causing the makeup remover to be dispensed through the tip assembly when the twistable middle section is rotated by a user;

a tubular compartment coupled to the twistable middle section sized to hold one or more replacement tip assemblies;

a removable cap for holding the replacement tip assemblies inside the tubular compartment; and a makeup applicator portion coupled to the removable cap, the makeup applicator portion comprising:

a base;

a second reservoir removably coupled to the base for storing makeup; and a makeup applicator wand extending from the base into the second reservoir when the second reservoir is coupled to the base.

14. The apparatus of claim 13, wherein the makeup remover comprises a viscosity of between 1 and 200 poise.

15. The apparatus of claim 14, wherein the makeup remover comprises an anhydrous skin cleansing composition containing an oil phase, an emulsifying agent, and particulate water soluble polymeric abrasive particles.

16. The apparatus of claim 13, wherein the tip assembly comprises:

a hollow extension inserted into the first end of the reservoir; and a porous tip, coupled to the hollow extension, for passing the makeup remover from the hollow extension and onto a surface of the tip.

17. The apparatus of claim 13, wherein the tip assembly is removably coupled to the first end of the reservoir.

18. The apparatus of claim 13, further comprising:

a compact mirror, comprising a mirrored surface and an opposing non-mirrored surface; and a clip coupled to the non-mirrored surface, the clip sized to removably retain the apparatus around a circumference of the reservoir.

* * * * *